US007765739B2

(12) United States Patent
Munezane et al.

(10) Patent No.: US 7,765,739 B2
(45) Date of Patent: Aug. 3, 2010

(54) ELEVATING DEVICE FOR WINDOW GLASS

(75) Inventors: Kozo Munezane, Kawachi-gun (JP); Takahiro Shinkai, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 669 days.

(21) Appl. No.: 11/613,765

(22) Filed: Dec. 20, 2006

(65) Prior Publication Data

US 2007/0144073 A1 Jun. 28, 2007

(30) Foreign Application Priority Data

Dec. 27, 2005 (JP) ..... 2005-374508

(51) Int. Cl.
*E05F 15/08* (2006.01)

(52) U.S. Cl. ..... 49/352; 49/349

(58) Field of Classification Search ..... 49/348–352
See application file for complete search history.

(56) References Cited

U.S. PATENT DOCUMENTS 4,608,778 A * 9/1986 Shiraishi et al. ..... 49/352
2004/0154227 A1* 8/2004 Yoshimura ..... 49/352

FOREIGN PATENT DOCUMENTS

DE 203 17 568 3/2005
EP 1 380 717 1/2004
JP 06-146710 5/1994
JP 11-303503 11/1999
JP 2001-049949 2/2001
JP 2002-129831 5/2002
JP 2004-060372 2/2004
WO 02/075090 9/2002

* cited by examiner

*Primary Examiner*—Katherine W Mitchell
*Assistant Examiner*—Michael J Keller
(74) *Attorney, Agent, or Firm*—Rankin, Hill & Clark LLP

(57) ABSTRACT

The present invention employed an elevating device for a window glass provided in a door of a vehicle, including: a guiding device which is provided in the door; a career plate which engages with the guiding device and slidably moves in an elevating direction of the window glass in relation to the guiding device; and a driving device which raises and lowers the career plate. The career plate is provided with a stopper which abuts on the guiding device when the career plate reaches an elevation-limiting position. The stopper is provided with an attaching portion which is attached to the career plate, and an abutting portion which abuts on the guiding device and elastically deforms when the stopper reaches the elevation-limiting position. The abutting portion is formed such that a width thereof becomes wider than the attaching portion and such that the width becomes smaller toward a distal end side.

8 Claims, 7 Drawing Sheets

ELEVATING DEVICE FOR WINDOW GLASS

BACKGROUND OF THE INVENTION

Priority is claimed on Japanese Patent Application No. 2005-374508, filed Dec. 27, 2005, the contents of which are incorporated herein by reference.

FIELD OF THE INVENTION

The present invention relates to an elevating device for a window glass, which is provided in a door of a vehicle.

DESCRIPTION OF THE RELATED ART

A conventional elevating device is proposed in which a stopper attached to a career plate which supports a window glass elastically abuts on a fixed member when the career plate reaches the lowermost position thereof (for example, refer to a pamphlet of PCT International Publication No. WO2002/075090).

However, in the conventional elevating device, there is a case in which knocking sound arises when the stopper abuts on the fixed member. Also, there is a case in which a control unit of a window actuator misapprehends the lowermost position of the window glass due to insufficient elastic deformation of the stopper.

The present invention was made in view of the above-mentioned circumstances, and has an object of providing an elevating device for a window glass which can prevent: knocking sound which occurs when a stopper abuts; and a setting error in the lowermost position of a window glass.

SUMMARY OF THE INVENTION

The present invention employed the followings in order to achieve the above object.

That is, the present invention employed an elevating device for a window glass provided in a door of a vehicle, including: a guiding device which is provided in the door; a career plate which engages with the guiding device and slidably moves in an elevating direction of the window glass in relation to the guiding device; and a driving device which raises and lowers the career plate, wherein: the career plate is provided with a stopper which abuts on the guiding device when the career plate reaches an elevation-limiting position thereof; the stopper is provided with an attaching portion which is attached to the career plate, and an abutting portion which abuts on the guiding device and elastically deforms when the stopper reaches the elevation-limiting position; and the abutting portion is formed such that a width thereof becomes wider than the attaching portion and such that the width becomes smaller toward a distal end side thereof.

According to the elevating device for a window glass, by forming the abutting portion so as to be narrower toward a distal end side thereof, the abutting portion can actively perform an elastic deformation thereof while abutting on the guiding device. Therefore, it is possible to prevent knocking sound arised when the stopper abuts. In addition, by actively performing the elastic deformation of the abutting portion, it is also possible to prevent a setting error in the elevation-limiting position of the career plate.

It may be arranged such that: a step portion is formed between the attaching portion and the abutting portion; and movements in the elevating direction of the step portion are restricted by a restricting wall provided on the career plate.

In this case, by restricting the movements in the elevating direction of the step portion, it is possible to obtain a stable deformation of the abutting portion.

It may be arranged such that: the abutting portion is formed so as to be shifted toward a direction orthogonal to the elevating direction in relation to the attaching portion; and a gap is formed between the abutting portion and the career plate.

In this case, by the gap provided between the abutting portion and the career plate for enabling deformation of the abutting portion, the abutting portion can be elastically deformed preferably.

A tapering face may be formed at a distal end side of the abutting portion so as to face the career plate.

In this case, it is possible to prevent a shifted-abutting of the abutting portion in relation to the guiding device, and thereby enabling improvement in the durability of the abutting portion. In addition, an interference with the career plate can be prevented.

A distal end of the abutting portion may be chamfered in an arc shape.

In this case, even when the abutting portion inclines a little, the abutting portion can stably abut on the guiding device.

DETAILED DESCRIPTION OF THE INVENTION

Figure 1:
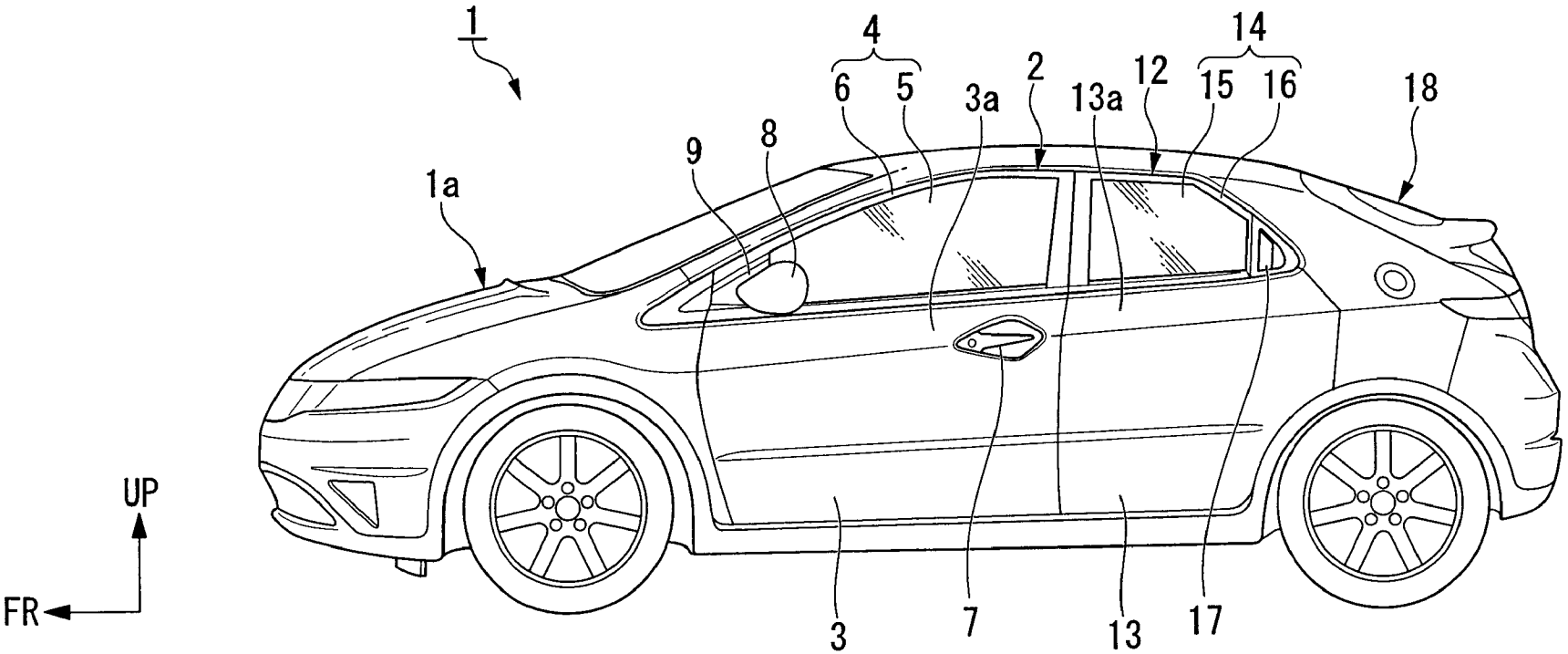
FIG. 1 shows a side view of a vehicle of an embodiment of the present invention.

An embodiment of the present invention will be explained below with reference to the drawings. Moreover, in the following explanation, directions such as forward, backward, left, and right correspond to directions of a vehicle, if no explanation is made. In addition, in the drawings, an arrow FR denotes the forward in the vehicle direction, and an arrow UP denotes an upper direction of the vehicle.

A two-box type vehicle 1 shown in FIG. 1 is provided with a vehicle body 1*a* of a monocoque construction which is formed by joining panel members and a vehicle frame member so as to form one body. Openings formed in the sides of the vehicle body 1*a* are openable and closable by front doors 2 and rear doors 12. Each of the front doors 2 is provided with a door main body 3 forming a lower section thereof, and a window section 4 forming an upper section thereof. In addition, each of the rear doors 12 is provided with a door main body 13 forming a lower section thereof, and a window section 14 forming an upper section thereof. The door section 4 of the door 2 is provided with a window glass 5 and a sash 6, as main components thereof. In addition, the window section 14 of the door 12 is provided with a window glass 15 and a sash 16, as main components thereof. A region surrounded by the sash 6 and a waist portion (an upper edge portion) 3*a* of the door main body 3 is opened and closed by elevations of the window glass 5. In addition, a region surrounded by the sash 16 and a waist portion (an upper edge portion) 13*a* of the door main body 13 is opened and closed by elevations of the window glass 15.

The front doors 2 and the rear doors 12 open and close centering on hinge shafts which are respectively provided on front end sides (bottom end sides) thereof and extend substantially in the vertical direction. A door outer handle 7 is provided on the rear and upper side of the door main body 3 of the front door 2 for opening and closing operations of the front door 2 from the cabin exterior side. In addition, a door outer handle 17 is provided on a rear end portion of the window section 14 of the rear door 12 for opening and closing operations of the rear door 12 from the cabin exterior side. A door mirror base 9 for supporting a door mirror 8 is provided on a front end portion of the window section 4 of the front door 2. Moreover, the reference symbol 18 in FIG. 1 denotes a tailgate which opens and closes an opening formed on the rear side of the vehicle body 1*a*.

Figure 2:
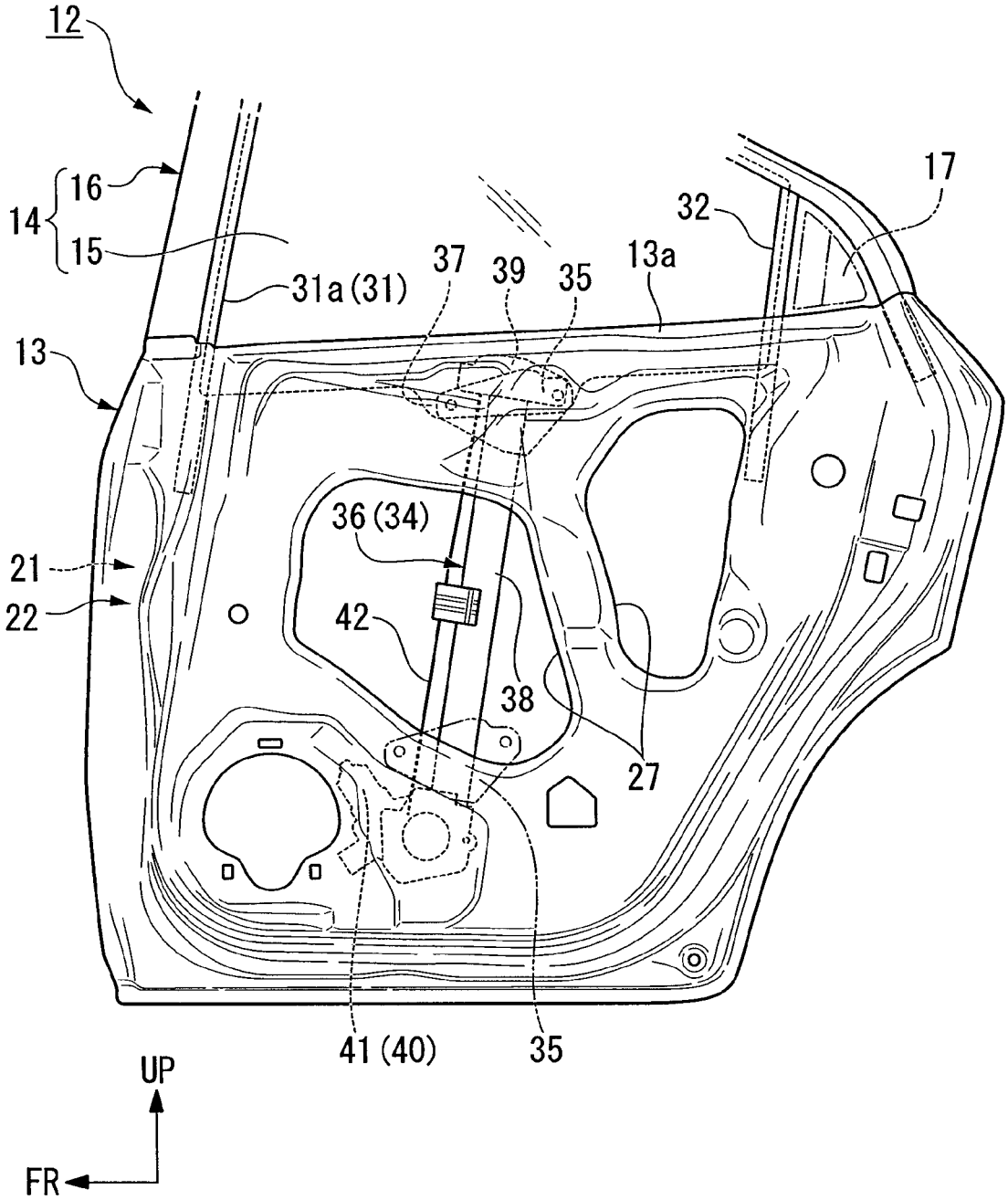
FIG. 2 shows a side view of a right rear door of the vehicle, seen from a cabin interior side (a left side).

As shown in FIG. 2, the door main body 13 of the rear door 12 has a hollow construction in which a door skin (an outer panel) 21 being a press-working product made of a steel plate and forming the cabin exterior side (exterior sides on left and right) thereof, and a door inner (an inner panel) 22 being a press-working product made of a steel plate and forming the cabin interior side (interior sides on the left and right) thereof, are unitarily joined with each other mainly by hemming at front and rear edges and lower edges thereof. At the upper edge (the waist portion 13*a*) of the door main body 13, the door skin 21 and the door inner 22 are separated with each other; and the window 15 can be inserted into and removed therethrough from a space inside the door main body 13 (a door interior space). A waist molding (not illustrated) is attached to the waist portion 13*a* in order to seal a gap with respect to the window glass 15.

Front edge portions (bottom end portions) of the door main bodies 13 are rotatably supported via the non-illustrated door hinges provided to the front edge portions of the side openings in the vehicle body 1*a*. When the rear door 12 is fully closed, a rear end portion (a free end portion) of the door main body 13 is supported by the side opening in the vehicle body 1*a* via a non-illustrated electric locking unit which is engageable with the rear end portion of the side openings in the vehicle body 1*a* by a ratch. Two center openings 27 are formed in a center region of the door inner 22 so as to be adjacent with each other in the vehicle length direction in order to insert the above-mentioned electric locking unit, an after-mentioned window regulator 34, and the like, into the door main body 13.

The sash 16 includes a main sash 31 which forms an external shape of the window section 14, and a sub-sash 32 which extends in the vertical direction at the rear end of the window section 14.

The main sash 31 is formed by performing processes such as bending process to a pipe-shaped member having the predetermined different cross-sectional shapes along it. A lower end of the main sash 31 arranged in the forward is inserted from upside into a front end portion of the door main body 13, while a lower end of the main sash 31 arranged in the rearward is inserted from upside into a rear end portion of the door main body 13; and these lower ends are thereby unitarily joined with the door main body 13.

In a side view, the sub-sash 32 is linearly inclined such that an upper portion thereof is located rearward. In addition, the sub-sash 32 is unitarily joined with the main sash 31, in a manner such that the upper end portion thereof is inserted into the inside of the rear end portion of the main sash 31, while the lower end portion thereof is inserted from upside into the rear end portion of the door main body 13.

The sub-sash 32 works as a rear guide rail which supports a rear edge of the window glass 15 via a rear edge of a non-illustrated run channel, such that the window glass 15 can elevate in the vertical direction. In the side view, a front edge 31*a* of the main sash 31 is arranged so as to be linearly inclined rearward, as same as the sub-sash 32. The front edge 31*a* works as a front guide rail which supports a front edge of the window glass 15 via a front edge of the above-mentioned run channel, such that the window glass 15 can elevate in the vertical direction.

The above-mentioned window regulator 34 is located at substantially the center of the door main body 13, in order to elevate the window glass 15.

The window regulator 34 is provided with: a career plate 35 which is attached to a lower edge of the window glass 15; an elevating mechanism (a guiding device) 36 which supports the career plate 35 and the window glass 15 so as to be able to elevate in the vertical direction; and a cable driving unit (a driving device) 40 which is unitarily attached to the elevating mechanism 36.

The substantially horizontal lower edge of the window glass 15 is hidden inside the door main body 13 even when the window glass 15 is positioned at the uppermost position in the elevating direction (i.e., the fully closed position of the window 14). A glass lower protrusion 37 is formed so as to protrude downward, on the lower edge of the window glass 15 at a substantially middle portion in the vehicle length direction thereof. The career plate 35 is attached to the glass lower protrusion 37.

The elevating mechanism 36 is provided with: a guide rail 38 which extends in the vertical direction while forming the same inclination as of those of the front edge 31*a* of the main sash 31 and the sub-sash 32, when the guide rail 38 is seen from the side thereof, and the cable driving unit 40 which is attached to the bottom end of the guide rail 38.

An upper end of the guide rail 38 is fixed via a bracket 39 to a position above the center openings 27 by bolting or the like. In addition, a lower end of the guide rail 38 is fixed via the cable driving unit 40 to a position under the center openings 27 by bolting or the like. Like this, the upper end and the lower end of the guide rail 38 are fixed to the door main body 13.

The cable driving unit 40 winds one of two cables 42 and releases another using a driving power of the electric motor 41. Ends of the both cables 42 are joined with the career plate 35 via non-illustrated pulleys which are supported at an upper end and lower end of the guide rail 38. Moreover, only one of the cables 42 is shown in order to explain them in the drawing. With the driving power by the electric motor 41, the career plate 35 is elevated along the guide rail 38. As a result, the window glass 15 elevates along the guide rail 38, the front edge 31*a* of the main sash 31, and the sub-sash 32. Moreover, in the drawings, the career plate 35 shown by dotted lines indicates it at the uppermost position in the elevating direction, while the career plate 35 shown by two-dotted lines indicates it at the lowermost position in the elevating direction.

Figure 3:
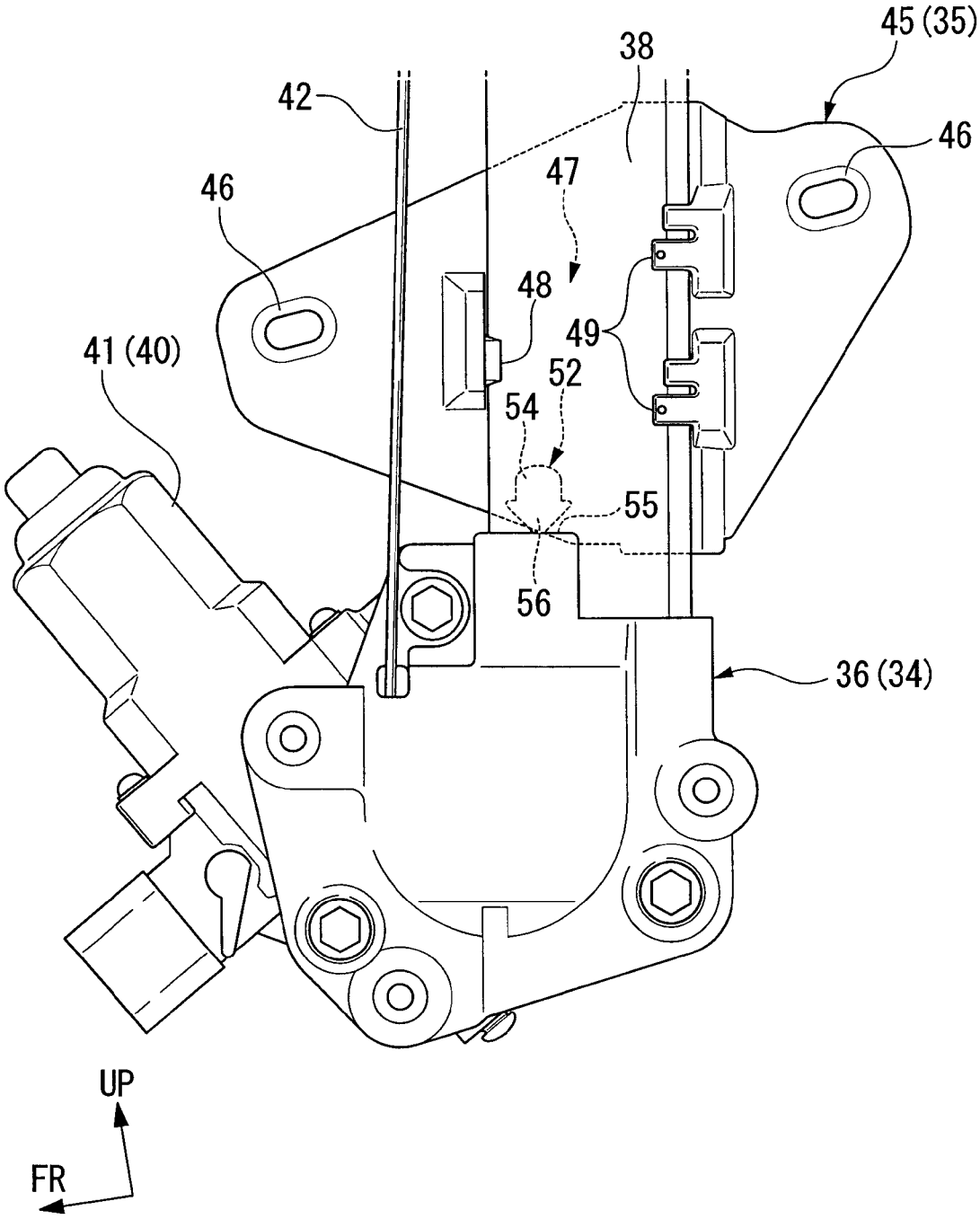
FIG. 3 shows a side view of a lower section of a window regulator in the right rear door, seen from the cabin interior side.

Explanation will be continued below with reference to FIG. 3. The career plate 35 is a single piece formed by an injection molding of, for example, a synthetic resin. The career plate 35 includes a plate-shaped plate main body 45 which is substantially vertical to cabin interior-exterior direction (hereinbelow, it may be referred to as "door interior-exterior direction"). In the side view, the plate main body 45 is formed so as to be long in the vehicle length direction, and so as to be a substantially diamond shape in which a rear end thereof directs upwards. Connectors 46 for connecting with the glass lower protrusion 37 of the window glass 15 are provided on both ends, in the vehicle length direction, of the plate main body 45. In addition, in the side view, a middle portion in the vehicle length direction of the plate main body 45 overlaps with the guide rail 38, and forms a rail-engaging portion 47 which engages with the guide rail 38 such that the plate main body 45 can elevate in the vertical direction.

Figure 4:
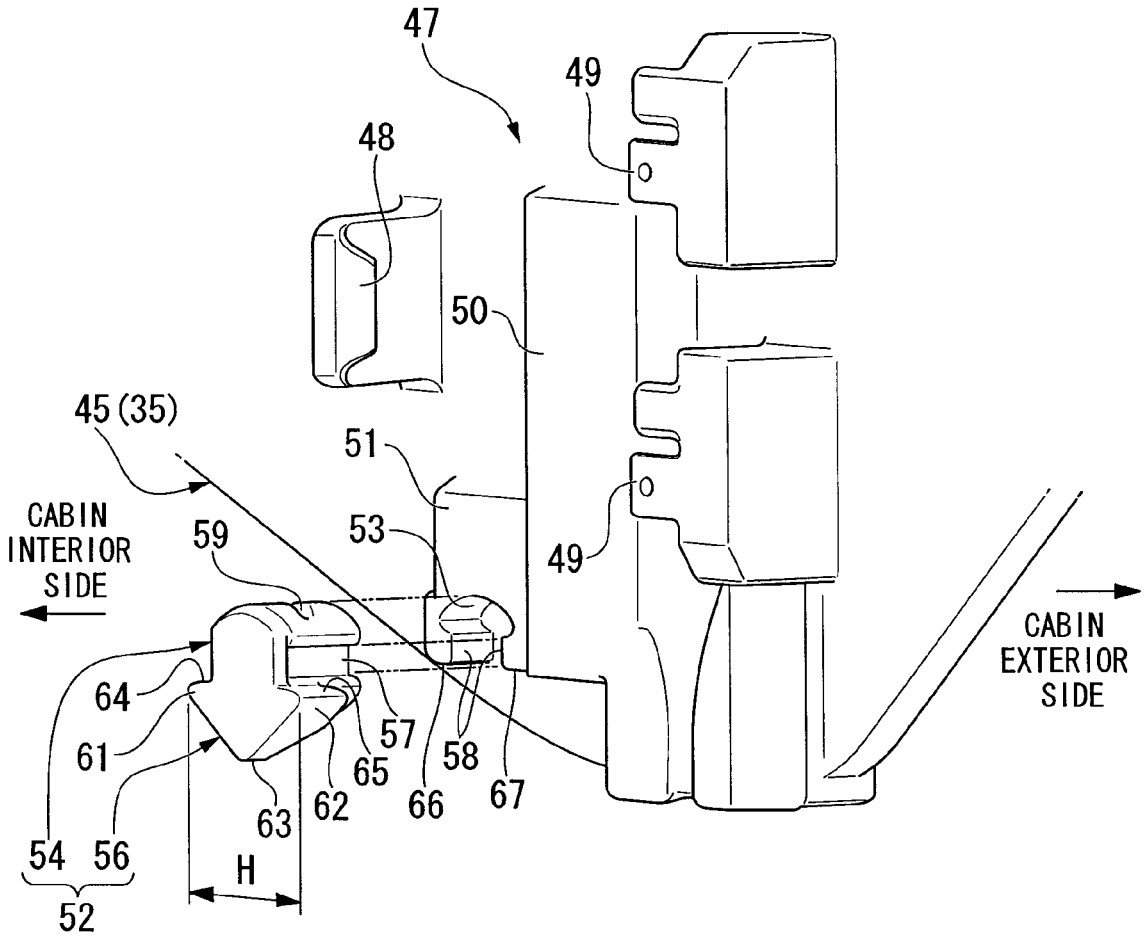
FIG. 4 shows a perspective view of a career plate and a stopper of the window regulator.

Explanation will be continued below with reference to FIG. 4. The rail-engaging portion 47 includes: a front engaging claw 48 which protrudes from the plate main body 45 toward the cabin interior side, and engages with the front leading edge of the guide rail 38; a rear engaging claws 49 which protrude from the plate main body 45 toward the cabin interior side, and engage with the rear leading edge of the guide rail 38; and a guiding protrusion 50 which protrudes from a position between the front engaging claw 48 and the rear engaging claws 49 toward the cabin interior side, and engages with the outside of the guide rail 38. The front engaging claw 48, the rear engaging claws 49, and the guiding protrusion 50 are engaged with the guide rail 38 so as to be slidable along the guide rail 38. The guiding protrusion 50 forms a rectangular solid-shape which is long in the vertical direction; and a front bottom protrusion 51 which is also formed in the rectangular solid-shape, is adjacently provided on the bottom and front side of the guiding protrusion 50.

At the bottom end of the career plate 35, a stopper 52 is attached which, when the career plate 35 reaches the lowermost position in the elevating direction (that is, when the window glass 15 reaches the lowermost position in the elevating direction), abuts on an upper end of the cable driving unit 40 located at the bottom end of the guide rail 38, and thereby stopping the career plate 35 further dropping.

The stopper 52 is made of elastic materials such as urethane rubber. This stopper 52 is unitarily formed by: an attaching portion 54 which is inserted into an under-mentioned concave portion for attaching 53 formed at a bottom end of the career plate 35; and an abutting portion 56 which abuts, when the career plate 35 reaches the lowermost position in the elevating direction, on an under-mentioned upper-end side supporting portion 55 formed on a top end of the cable driving unit 40.

Figure 5:
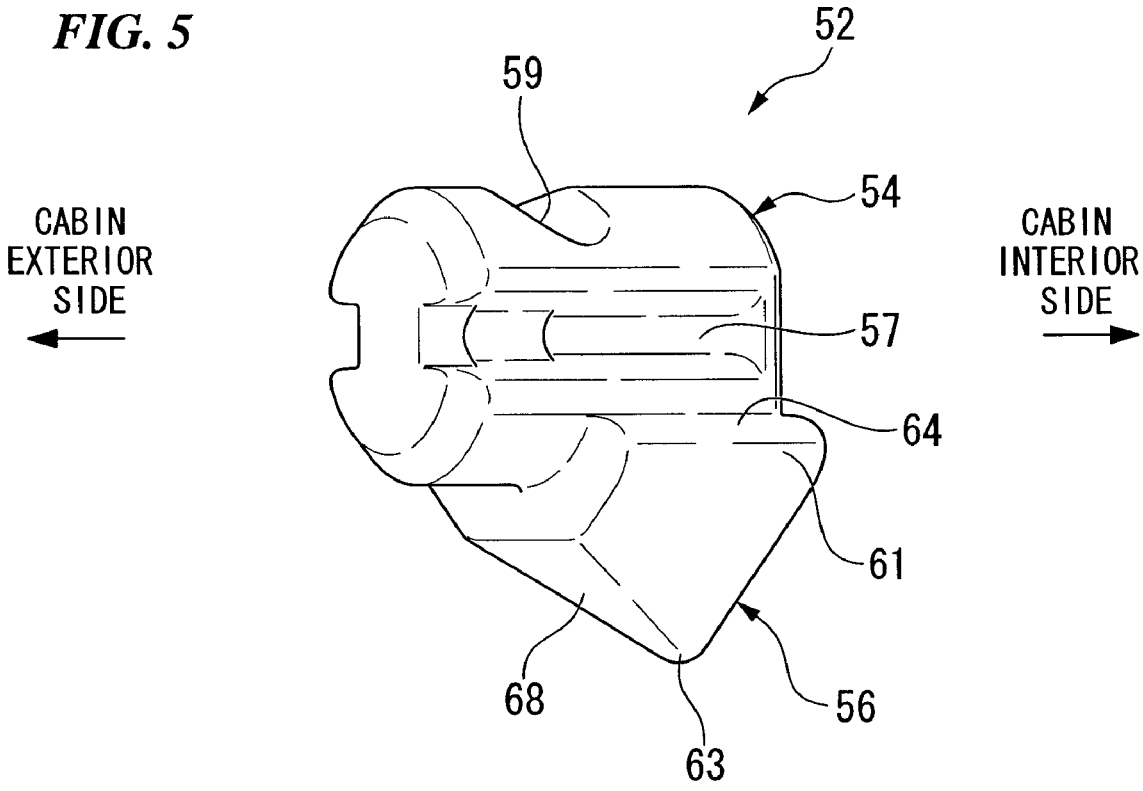
FIG. 5 shows a perspective view of the stopper, seen from an opposite side to FIG. 4.

Explanation will be continued below with reference to FIG. 5. The attaching portion 54 is a short cylinder-shaped member which extends in the door interior-and-exterior direction, and has an ellipse cross-sectional shape which is somewhat long in the vertical direction. Engaging grooves 57 are formed on both of front and rear sides of the attaching portion 54, within a region from a position near the cabin exterior side end to a position reaching the cabin interior side, along the door interior-and-exterior direction. On the other hand, the above-mentioned notch-shaped concave portion for attaching 53 is formed in the bottom end of the above-mentioned front bottom protrusion 51 of the career plate 35. The concave portion for attaching 53 includes: a cylindrical-shaped interior face which fits an upper portion of the attaching portion 54; and an engaging protruding portions 58 which fit into the front and rear engaging grooves 57. The attaching portion 54 is supported by inserting it into the concave portion for attaching 53 from the cabin interior side. An engaging concave portion 59 which suitably engages with the inside of the concave portion for attaching 53 is formed on an upper end of the attaching portion 54, in order to prevent dropping off of the attaching portion 54 from the concave portion for attaching 53. In addition, an exterior edge on the cabin exterior side of the attaching portion 54 is chamfered for easy insertion thereof into the concave portion for attaching 53.

The abutting portion 56 is formed, when it is seen in the side view, in a reversed triangular shape in which one part thereof overlaps with the lower portion of the attaching portion 54. The abutting portion 56 includes: a front top portion 61 and a rear top portion 62 which are separated with each other in both of the forward and backward of the bottom of the attaching portion 54; and a lowermost portion 63 which departs downward with respect to the attaching portion 54. The abutting portion 56 has the predetermined thickness along the door interior-and-exterior direction. The abutting portion 56 is continuously provided on the bottom side and the vehicle interior side of the attaching portion 54 so as to cover the bottom side and the vehicle interior side of the attaching portion 54. That is, the abutting portion 56 is provided so as to be shifted with respect to the attaching portion 54 along the door interior-and-exterior direction (i.e., the direction orthogonal to the window glass elevating direction). In other words, a cabin exterior side end portion of the attaching portion 54 is provided so as to protrude toward the cabin exterior side than the cabin exterior side end portion of the abutting portion 56. The cabin interior side end face of the abutting portion 56 and the cabin interior side end face of the attaching portion 54 are formed so as to be in the same one plane.

The abutting portion 56 is formed such that the maximum width H in the vehicle length direction which is substantially orthogonal to the elevating direction of the career plate 35 (i.e., the maximum width H corresponds to the distance between the font end and the rear end) is wider than the maximum width of the attaching portion 54. Furthermore, the abutting portion 56 is formed such that the width thereof in the vehicle length direction becomes narrower toward the downward of the career plate 35 (i.e., toward the upper-end side supporting portion 55 of the cable driving unit 40).

Figure 6:
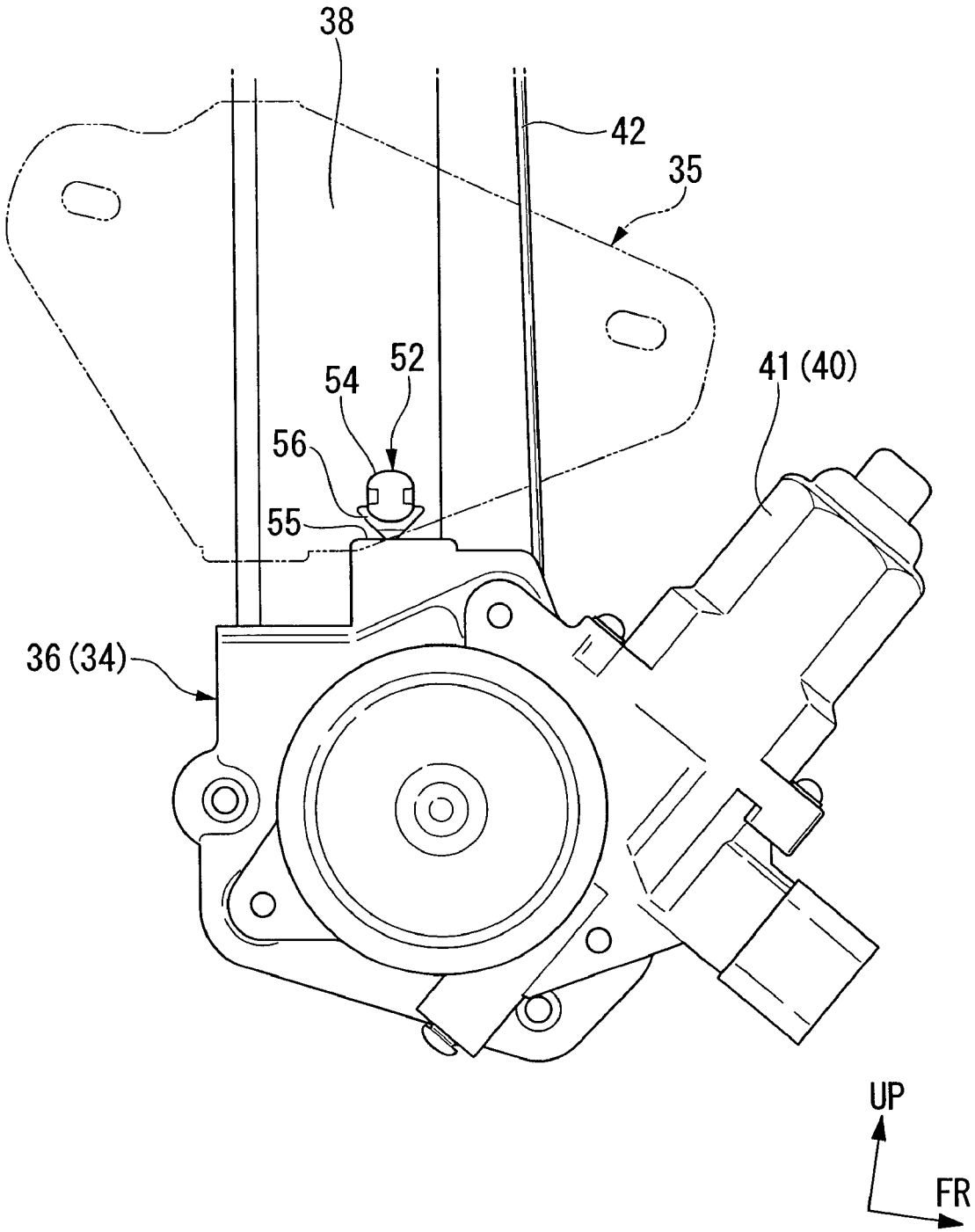
FIG. 6 shows a side view of the lower section of the window regulator, seen from the cabin exterior side (a right side).

Explanation will be continued below with reference to FIG. 6. The upper-end side supporting portion 55 is a rectangular solid-shaped portion which is formed on a casing upper end portion of the cable driving unit 40. The lowering career plate 35 is stopped when the distal end (the lowermost portion 63) of the abutting portion 56 abuts on the upper face of the upper-end side supporting portion 55 and the distal end of the abutting portion 56 is elastically deformed in a suitable manner.

The cable driving unit 40 is driven and controlled by a non-illustrated electric control unit. The electric control unit renews the setting value of the lowermost position in the elevating direction of the career plate 35 and the window glass 15, in accordance with the reaction force generated when career plate 35 reaches the lowermost position in the elevating direction, and when the abutting portion 56 of the stopper 52 abuts on the upper-end side supporting portion 55 and is then elastically deformed. And the electric control unit thereby watches the elevation position of the window glass 15 based on the latest setting value of the lowermost position in the elevating direction. That is, the degree of deformation of the stopper 52 when the window glass 15 is fully closed, affects on the opening-and-closing control of the window glass 15.

A forward step 64 and a rear step 65 are formed between the front top portion 61 and the rear top portion 62 of the abutting portion 56, and the exterior of the attaching portion 54. Each of the forward step 64 and the rear step 65 forms a substantially flat portion. In addition, the front restricting wall 66 and the rear restricting wall 67 are formed on the forward and rearward of the concave portion for attaching 53 located on the bottom end of the front bottom protrusion 51 of the career plate 35. Each of the front restricting wall 66 and the rear restricting wall 67 forms a substantially flat portion. When the stopper 52 is installed into the career plate 35, the forward step 64 and the rear step 65 of the abutting portion 56 contact, from the lower side, with the front restricting wall 66 and the rear restricting wall 67. Thereby, since inclination of the abutting portion 56 with respect to the vehicle length direction can be suppressed, a movement of the abutting portion 56 in the upward will be restricted equivalently at both of forward and backward, when the stopper 52 abuts on the upper-end side supporting portion 55. And thereby, it becomes possible to maintain the reproducibility of the stable elastic deformation of the abutting portion 56.

A distal end of the abutting portion 56 is chamfered so as to be formed in an arc-shape having a comparatively small diameter. Thereby, even when the relational inclination arised between the stopper 52 and the guide rail 38, the stable elastic deformation can be reproduced since the distal end of the abutting portion 56 stably abuts on the upper-end side supporting portion 55.

Figure 7:
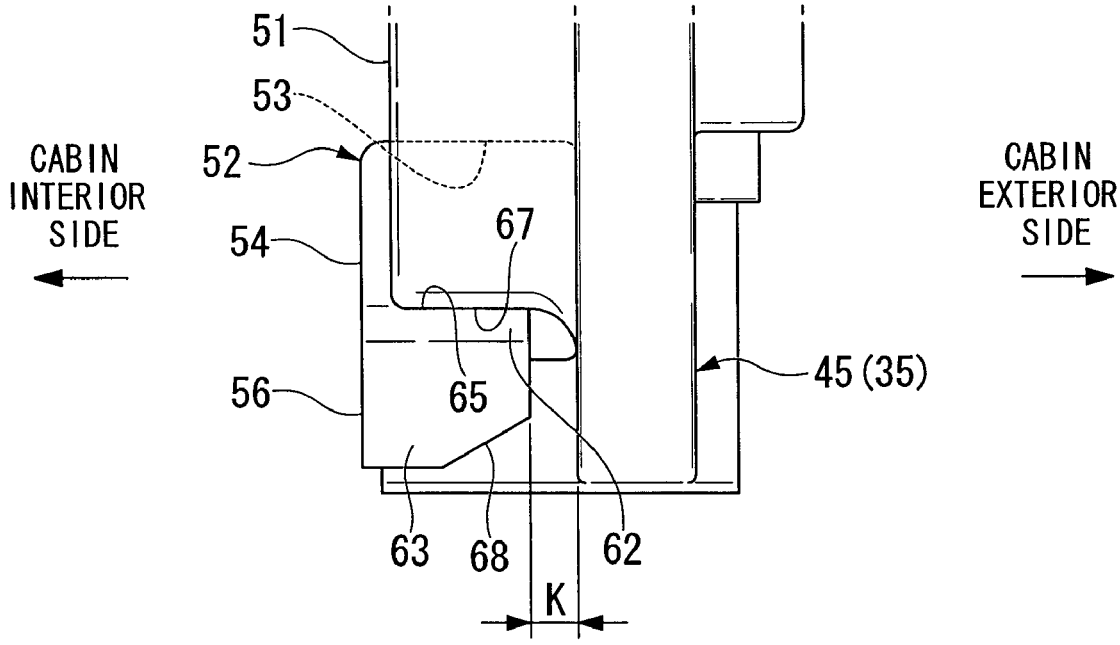
FIG. 7 shows an explanatory view of the stopper attached to the career plate, seen from a rear side.

Explanation will be continued below with reference to FIG. 7. A cabin exterior side end of the attaching portion 54 contacts a cabin interior side bottom face (an internal face of the plate main body 45) in the concave portion for attaching 53. At this time, the attaching portion 54 engages with the career plate 35 by the length of the front and rear engaging grooves 57, and a cabin exterior side end portion of the attaching portion 54 protrudes toward the cabin interior side of the concave portion for attaching 53.

In addition, the cabin exterior side end of the abutting portion 56 at this time is apart from the internal face of the plate main body 45, and thereby forming the predetermined gap "K" therebetween. A corner portion on the career plate 35 side of the abutting portion 56 is formed so as to be closer to the cabin interior side as approaching to the upper-end side supporting portion 55 sides, and thereby forming a comparatively large and inclined chamfered face thereon. At this portion, a flat tapering face 68 is formed so as to be narrower toward the distal end side of the abutting portion 56.

As has been explained in the above, the elevating device for a window glass of the present embodiment is provided with: the elevating mechanism 36 installed in the rear door 12 of the vehicle 1; the career plate 35 which engages with the elevating mechanism 36, and slidably contacts with the elevating mechanism 36 in the elevating direction of the window glass 15; and the cable driving unit 40 which elevates the career plate 35 in the vertical direction. The career plate 35 is provided with the stopper 52 which abuts on the elevating mechanism 36 when the career plate 35 reaches the lowermost position in the elevating direction. The stopper 52 is provided with: the attaching portion 54 attached into the career plate 35; and the abutting portion 56 which abuts on the elevating mechanism 36 and elastically deforms when the abutting portion 56 reaches the lowermost position in the elevating direction. The abutting portion 56 is formed such that the width in the vehicle direction becomes wider than that of the attaching portion 54, and such that the width becomes in the vehicle direction becomes smaller as approaching to the distal end side thereof.

According to the above-mentioned construction, by forming the abutting portion 56 so as to be narrower toward a distal end side thereof, the abutting portion 56 can actively perform an elastic deformation while abutting the elevating mechanism 36. Therefore, it is possible to prevent knocking sound arised when the stopper 52 abuts. In addition, by actively performing the elastic deformation of the abutting portion 56, it is also possible to prevent a setting error in the elevation-limiting position of the career plate.

In addition, in the elevating device for a window glass, the forward step 64 and the rear step 65 are formed between the attaching portion 54 and the abutting portion 56. Movements in the elevating direction of these forward step 64 and rear step 65 are restricted by the front restricting wall 66 and the rear restricting wall 67 which are formed on the career plate 35, thereby enabling stable deformation of the abutting portion 56.

Furthermore, in the elevating device for a window glass, the abutting portion 56 is shifted to the direction orthogonal to the elevating direction in relation to the attaching portion 54, and thereby forming the gap "K" between the abutting portion 56 and the career plate 35. With this construction, since the abutting portion 56 can deform in the direction orthogonal to the elevating direction, the abutting portion 56 can be elastically deformed in a suitable manner.

Furthermore, in the elevating device for a window glass, the tapering face 68 is formed on the butting portion 56 at the distal end side and the side facing the attaching portion 54 thereof. With this construction, it is possible to prevent a shifted-abutting of the abutting portion 56 in relation to the elevating mechanism 36, and thereby enabling improvement in the durability of the abutting portion 56. In addition, an interference with the career plate 35 can be prevented.

Furthermore, in the elevating device for a window glass, since the distal end portion (the lowermost portion 63) of the abutting portion 56 is chamfered in an arc shape, even when the abutting portion 56 inclines a little, the abutting portion 56 can stably abut on the elevating mechanism 36.

While preferred embodiment of the invention has been described and illustrated above, it should be understood that this is an exemplary of the invention and is not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

Moreover, the present invention is not limited only to the above-embodiment, and is also applicable to the front doors 2 instead of the rear doors 3.

What is claimed is:

1. An elevating device for a window glass provided in a door of a vehicle, comprising:

a guiding device which is provided in the door;

a carrier plate which engages with the guiding device and slidably moves in an elevating direction of the window glass in relation to the guiding device; and a driving device which raises and lowers the carrier plate, wherein:

the carrier plate includes a pair of vertically oriented planar faces;

the carrier plate is provided with a stopper which abuts on the guiding device when the carrier plate reaches an elevation-limiting position thereof;

the stopper is provided with an attaching portion which is attached to the carrier plate such that a carrier plate facing surface of the stopper attaching portion is in direct contact with one of the vertically oriented planar faces of the carrier plate, and an abutting portion which abuts on the guiding device and elastically deforms when the stopper reaches the elevation-limiting position; and the abutting portion is formed such that a width thereof becomes wider than the attaching portion and such that the width becomes smaller toward a distal end side thereof, wherein:

a step portion is formed between the attaching portion and the abutting portion; and movements in the elevating direction of the step portion are restricted by a restricting wall provided on the carrier plate.

2. The elevating device for a window glass provided in a door of a vehicle, comprising:

a guiding device which is provided in the door;

a carrier plate which engages with the guiding device and slidably moves in an elevating direction of the window glass in relation to the guiding device; and a driving device which raises and lowers the carrier plate, wherein:

the carrier plate includes a pair of vertically oriented planar faces;

the carrier plate is provided with a stopper which abuts on the guiding device when the carrier plate reaches an elevation-limiting position thereof;

the stopper is provided with an attaching portion which is attached to the carrier plate such that a carrier plate facing surface of the stopper attaching portion is in direct contact with one of the vertically oriented planar faces of the carrier plate, and an abutting portion which abuts on the guiding device and elastically deforms when the stopper reaches the elevation-limiting position; and the abutting portion is formed such that a width thereof becomes wider than the attaching portion and such that the width becomes smaller toward a distal end side thereof, wherein:

the abutting portion is formed so as to be shifted toward a direction orthogonal to the elevating direction in relation to the attaching portion;

a gap is formed between the abutting portion and the carrier plate;

the abutting portion includes a top portion at a distance from the attaching portion in the elevating direction; and part of the abutting portion overlaps with a lower portion of the attaching portion in the elevating direction.

3. The elevating device for a window glass, according to claim 1, wherein a tapering face is formed at a distal end side of the abutting portion so as to face the carrier plate.

4. The elevating device for a window glass, according to claim 1, wherein:

a distal end of the abutting portion is chamfered in an arc shape; and the abutting portion is formed in a reverse triangular shape as seen from a direction orthogonal to the elevating direction.

5. The elevating device for a window glass according to claim 3, wherein:

the abutting portion includes a linear portion provided at a distal end thereof and provided at a distal end side opposite to the distal end side on which the tapering face is formed; and the linear portion extends in a direction orthogonal to the elevating direction.

6. The elevating device for a window glass, according to claim 2, wherein a tapering face is formed at a distal end side of the abutting portion so as to face the carrier plate.

7. The elevating device for a window glass, according to claim 2, wherein:

a distal end of the abutting portion is chamfered in an arc shape; and the abutting portion is formed in a reverse triangular shape as seen from a direction orthogonal to the elevating direction.

8. The elevating device for a window glass according to claim 6, wherein:

the abutting portion includes a linear portion provided at a distal end thereof and provided at a distal end side opposite to the distal end side on which the tapering face is formed; and the linear portion extends in a direction orthogonal to the elevating direction.

* * * * *

UNITED STATES PATENT AND TRADEMARK OFFICE

CERTIFICATE OF CORRECTION

PATENT NO. : 7,765,739 B2
APPLICATION NO. : 11/613765
DATED : August 3, 2010
INVENTOR(S) : Munezane et al.

It is certified that error appears in the above-identified patent and that said Letters Patent is hereby corrected as shown below:

On the Title Page, Item (57), under "ABSTRACT", in Column 2, Line 3, delete "career" and insert -- carrier --

On the Title Page, Item (57), under "ABSTRACT", in Column 2, Line 7, delete "career plate. The career plate is" and insert -- carrier plate. The carrier plate is --

On the Title Page, Item (57), under "ABSTRACT", in Column 2, Line 8, delete "career" and insert -- carrier --

On the Title Page, Item (57), under "ABSTRACT", in Column 2, Line 10, delete "career" and insert -- carrier --

Signed and Sealed this
Eighteenth Day of January, 2011

David J. Kappos

David J. Kappos
*Director of the United States Patent and Trademark Office*